United States Patent [19]

Stahlecker et al.

[11] Patent Number: 4,653,264

[45] Date of Patent: Mar. 31, 1987

[54] ARRANGEMENT FOR OPEN-END FRICTION SPINNING

[75] Inventors: Fritz Stahlecker, Josef-Neidhart-Strasse 18, 7347 Bad Ueberkingen; Kurt Lang, Lauterstein, both of Fed. Rep. of Germany

[73] Assignees: Fritz Stahlecker, Fed. Rep. of Germany; Hans Stahlecker, Fed. Rep. of Germany

[21] Appl. No.: 871,817

[22] Filed: Jun. 9, 1986

[30] Foreign Application Priority Data

Jun. 8, 1985 [DE] Fed. Rep. of Germany ..... 3520636

[51] Int. Cl.[4] ..... D01H 7/898; D01H 7/892

[52] U.S. Cl. ..... 57/401; 57/411

[58] Field of Search ..... 57/400, 401, 411, 415

[56] References Cited

U.S. PATENT DOCUMENTS 4,107,909 8/1978 Fehrer et al. ..... 57/401 X 4,367,623 1/1983 Parker et al. ..... 57/401 X 4,557,105 12/1985 Brockmanns et al. ..... 57/401

4,571,932 2/1986 Stahlecker et al. ..... 57/401

4,586,325 5/1986 Wassenhoven ..... 57/401 X

*Primary Examiner*—Donald Watkins

*Attorney, Agent, or Firm*—Barnes & Thornburg

[57] ABSTRACT

An arrangement is provided for open-end friction spinning including a pair of adjacently arranged suction rollers rotatable in the same rotational direction. One roller rotates into the wedge-shaped gap formation zone and the other rotates out of the wedge-shaped gap. It is provided that the suction slot of the suction insert inside of the roller rotating into the wedge-shaped gap is longer than the suction slot of the suction insert of the roller rotating out of the wedge-shaped gap. The portion of the suction slot of the roller rotating into the yarn formation zone which extends beyond the slot of the roller rotating out of the yarn formation zone is displaced circumferentially from the wedge-shaped gap so as to provide for enhanced spinning conditions in the region of the yarn tip.

20 Claims, 13 Drawing Figures

ARRANGEMENT FOR OPEN-END FRICTION SPINNING

BACKGROUND AND SUMMARY OF THE INVENTION

The present invention relates generally to an arrangement for open-end friction spinning having two rollers that are arranged next to one another, are drivable in the same rotational direction and form a wedge-shaped gap used for yarn forming. The rollers each have a perforated shell and suction inserts arranged therein. The inserts are each provided with a suction slot facing the wedge-shaped gap and extending essentially along in the direction of the wedge-shaped gap. Also included is a feeding device that feeds individual fibers to the wedge-shaped gap in a scatter zone, a withdrawal device that withdraws the forming yarn in a longitudinal direction relative to the wedge-shaped gap from the scatter zone and a connected processing zone of the wedge-shaped gap.

It was found that by means of arrangements of this type, as are are disclosed, for example, in DE-OS 33 21 228 and AT-PS 339 778, yarns of a satisfactory quality can be spun. This is particularly true when, in accordance with the disclosure of to DE-OS 33 21 228, it is provided that the friction effect in the area of the scatter zone is adapted to the forming yarn in such a way that the lowest friction effect exists in the area of the yarn tip and the highest friction effect exists in the area of the end of the scatter zone located in yarn withdrawal direction. However, in the case of these arrangements, the yarn breakage number is unsatisfactory.

An arrangement is also known (DE-OS 30 08 622) in which the scatter zone extends practically over the whole axial length of the two rollers. The suction slots of the suction inserts are inclined with respect to a plane placed through the roller axes in such a way that the opening of the suction slots enlarges gradually in the withdrawal direction of the yarn. In this case, it is also provided that the width of the suction slot (in the circumferential direction of the suction insert) of the roller rotating into the wedge shaped gap is larger than the width of the suction slot of the suction insert of the roller rotating out of the wedge-shaped gap.

An objective of the present invention is the provision of an arrangement of the initially mentioned type wherein the number of yarn breakages is reduced.

This objective and other objectives of the present invention are achieved by providing the suction slot of the suction insert of the roller rotating into the wedge-shaped gap with a greater length than the suction slot of the suction insert of the roller rotating out of the wedge-shaped gap.

By means of an arrangement of this type, longer running periods are possible with fewer yarn breakages. It is believed that the reason for this improvement is that the spinning tension is reduced to a suitable extent without any significant impairment of the friction effect.

In a further development of the invention, it is provided that the suction slot of the suction insert of the roller rotating out of the wedge-shaped gap extends essentially only over the processing zone. By means of this development, particularly favorable results are obtained with respect to a low frequency of yarn breakages and a high yarn quality. In this case, the suction air flow directed into the roller rotating out of the wedge-shaped gap is essentially effective only in the processing zone.

In a further development of the invention, it is provided that the suction insert of the roller rotating out of the wedge-shaped gap, in the area of the scatter zone, is equipped with at least one air inlet opening aimed at the wedge-shaped gap, and that the shell of this roller is perforated in this area. As a result, individual fibers are effectively prevented from being caught at the roller rotating into the wedge-shaped gap and rotating together with it. In this case, it is sufficient for the at least one air inlet opening to have an inlet cross-section that is only a fraction of the inlet cross-section of the suction slot of this suction insert.

In a further development of the invention, it is provided that the suction slot of the suction insert of the roller rotating into the wedge-shaped gap, in the area of the scatter zone, has a section that - looking in circumferential direction of this roller - exhibits a greater separation from the wedge-shaped gap than the section located in the area of the processing zone. This section, that is larger opposite the rotating direction, has the result that a softer twist is introduced in the area of the yarn tip, while at the same time the inclination of the yarn tip to form curls is reduced. By the placing of this section of the suction slot away from the wedge-shaped gap, the suction air flow is displaced somewhat out of the wedge-shaped gap.

In a further development of the invention, it is provided that the suction inset of the roller rotating into the wedge-shaped gap, at least in the area of the scatter zone, is equipped with an adjusting device by means of which the free cross-section of the section or of the sections of the suction slot of the suction insert can be adjusted. As a result, it is possible to precisely dose the suction pull and thus also the tension affecting the yarn tip and, if necessary, also adapt it to a different fiber material to be spun.

In a further development of the invention, it is provided that the feeding device contains a fiber feeding duct that has a mouth extending in a slot-shaped way in the direction of the wedge-shaped gap. The transport direction of the fiber feeding duct has a component that is directed against the yarn withdrawal direction. This construction that is disclosed by itself in DE-OS 30 08 622, results in an improved yarn quality especially in connection with the arrangement and alignment of the suction slots of the suction inserts according to the present invention.

Further objects, features, and advantages of the present invention will become more apparent from the following description when taken with the accompanying drawings, which show for purposes of illustration only, an embodiment constructed in accordance with the present invention.

DETAILED DESCRIPTION OF THE DRAWINGS

Figure 1:
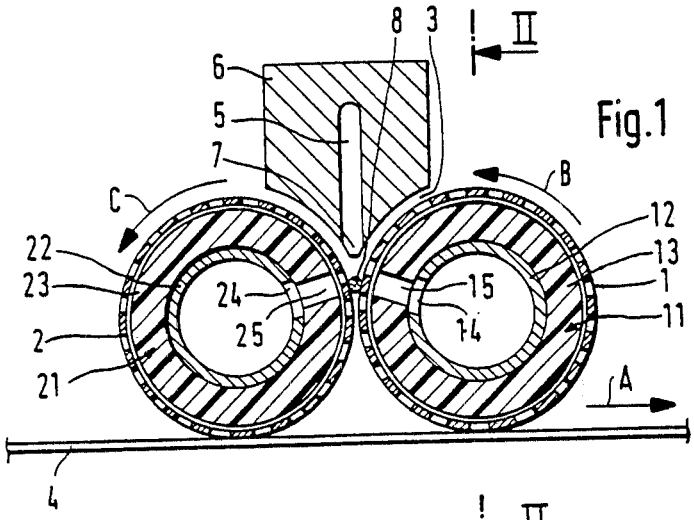
FIG. 1 is a cross-section through the rollers of an open-end friction spinning arrangement and the suction inserts located therein in accordance with the present invention.

The arrangement for open-end friction spinning shown in FIG. 1 has two rollers 1 and 2 that are arranged adjacent one another and in parallel with respect to one another and together form a wedge-shaped gap 3. The two rollers 1 and 2 are driven in the same rotational direction by a tangential belt 4 that moves in the direction of the arrow A and rests directly against the shells of the rollers 1 and 2 so that the rollers 1 and 2 are rotated in the direction of arrows B and C. The roller 1 therefore rotates into the wedge-shaped gap 3.

Figure 2:
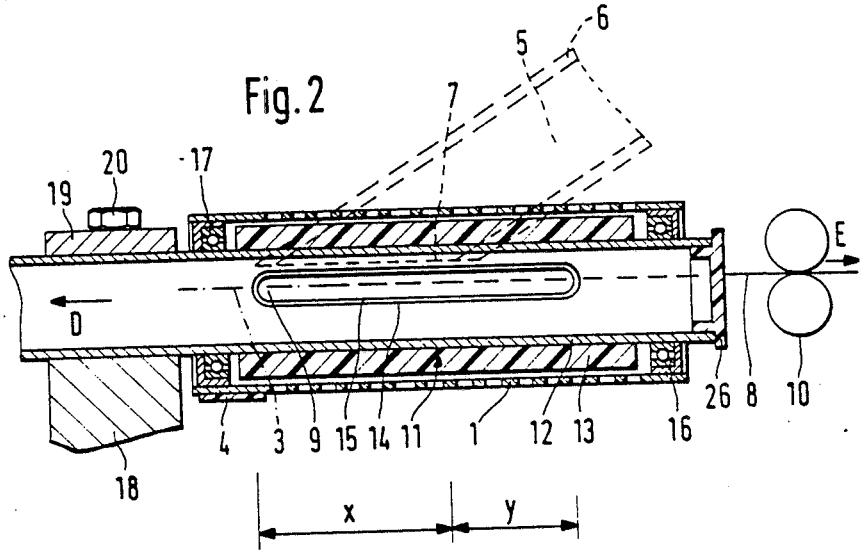
FIG. 2 is a section along Line II—II through the arrangement according to FIG. 1.

Fiber material that has been separated into individual fibers by conventional devices is fed to the wedge-shaped gap 3 via a fiber feeding duct 5 arranged in a duct housing 6. The mouth 7 of the fiber feeding duct 5 extends in a slot-shaped manner in a longitudinal direction along the wedge-shaped gap 3 and at a close distance from it. The length of the mouth 7 extending in the direction of the wedge-shaped gap 3 forms the so-called scatter zone x through which the fibers are fed in a distributed way. The fibers fed to the scatter zone x are twisted together into a yarn 8, in the wedge-shaped gap 3. This yarn is withdrawn in the direction of the arrow E along the wedge-shaped gap 3 by means of a withdrawal device 10 formed by a pair of rollers. The yarn 8, subsequently, via a wind-up device that is not shown, is wound onto a wound package. As shown in FIG. 2, the fiber feeding duct 5 is arranged at an acute angle with respect to the withdrawal direction E in such a way that the fibers with one component are fed against this yarn withdrawal direction E. The end of the yarn 8 located opposite from the withdrawal direction 10 forms a so-called yarn tip 9 that has the smallest number of fibers. At the end of the scatter zone x, the yarn 8 has reached the maximum number of fibers and is then twisted together further and smoothened in a subsequent procesing zone y.

On the inside of the roller 1 rotating into the wedge-shaped gap 3, a suction insert 11 is arranged that contains a tube 12 on which a sleeve 13 is arranged that covers the distance between the tube 12 and the shell of the roller 1. The sleeve 13 preferably consists of plastic. The shell of the roller 1, by means of roller bearings 16 and 17, is disposed directly on the tube 12. The sleeve 13 extends essentially over the area between the two rollers bearings 16 and 17.

On one side, the tube 12 is closed by a plug 26. The other end of this tube projects beyond the shell of the roller 1. At this end, it is connected to a vacuum source that is not shown. This end of the tube 12, by means of a tool holder 19, is clamped into a bearing housing 18. The tool holder 19, by means of a screw 20, is fixed that the bearing housing 18. The tube 12 has a longitudinal slot 14 that extends along the wedge-shaped gap 3 and faces it. The longitudinal gap 14 extending over the scatter zone x and the processing zone y. The sleeve 13 is equipped with a suction slot 15 that extends essentially in parallel to the longitudinal slot 14 but is somewhat narrower.

The roller 2 rotating out of the wedge-shaped gap 3 is developed as a suction roller in a similar way. It contains a suction insert 21 having a tube 22 onto which a sleeve 23 is fitted. The sleeve 23 preferably consists of plastic. The tube 22 has a longitudinal slot 24 extending in along the wedge-shaped gap 3 and facing it. A suction slot 25 is arranged in the sleeve 23 that extends in parallel to the longitudinal slot 24 with the suction slot 25 being somewhat narrower. The shell of the roller 2, also by means of roller bearings, is disposed directly on the tube 22 that is also clamped into the housing 18. The tube 22 is also connected to a vacuum source, preferably to the same vacuum source to which tube 12 is also connected.

The suction slot 15 as well as the longitudinal slot 14 of the tube of the roller 1 rotating into the wedge-shaped gap 3 extend over the whole length of the scatter zone x and the processing zone y. The suction slot 25 of the sleeve 23 and the longitudinal slot 24 of the tube 22 of the roller 2 rotating out of the wedge-shaped gap 3, however extend essentially only over the processing zone y. The shells of the rollers 1 and 2 are each, over the range of their axial lengths, provided with a perforation that corresponds to the length of the suction slots 15 and 25. The shells of the rollers 1 and 2 have a metallic surface with a preselected roughness or coefficient of friction.

In the area of the scatter zone x, an air current is generated by means of the suction slot 15 of the suction insert 11. This air current flows into the wedge-shaped gap 3 and the roller 1 and is essentially drawn in fron the fiber feeding duct 5. This air current, on the one hand, is used as a transport air current for the the fiber material fed via the fiber feeding duct 5 and, on the other hand, for holding of the forming yarn 8 in the wedge-shaped gap 3 during a spinning operation. In the area of the processing zone y, an air current is drawn in via both suction slots 15 and 25. This air current flows into the wedge shaped gap 3 and through the shells of the rollers 1 and 2. By means of this arrangement of the suction slots 15 and 25, a uniform yarn 8 is spun that is satisfactory with respect to quality. The number of yarn breakages is clearly reduced as compared to an arrangement wherein the suction slot of the roller 2 rotating out of the wedge-shaped gap 3 extends along the whole area of the scatter zone x.

In addition to the improvement achieved by means of the suction slots 15 and 25 of different lengths, additional improvements may also be achieved when special shapes are provided for the suction slots 15, particularly in the area of the scatter zone x.

Figure 3A:
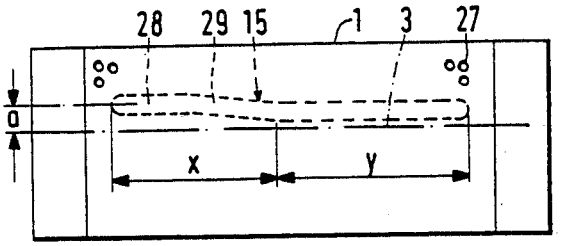
FIGS. 3A and 3B show the basic arrangement and alignment of the suction slots of two rollers of an arrangement forming a wedge-shaped gap in accordance with the present invention.
Figure 3B:
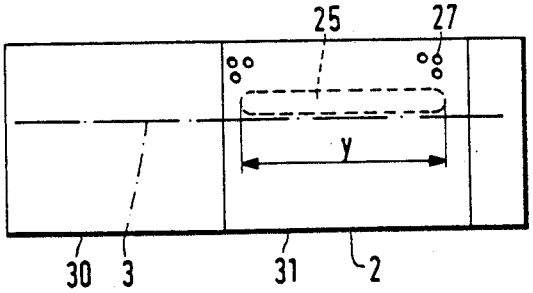

FIGS. 3A and 3B show a roller 1 rotating into the wedge-shaped gap 3 and a roller 2 rotating out of the wedge-shaped gap 3 developed corresponding to the embodiment according to FIGS. 1 and 2, i.e., suction slot 25 extends only over the area of the processing zone y. In the shell area 31 that is assigned to this processing zone y, the shell of the roller 2 is provided with a perforation 27. In the shell area 30 located essentially in the area of the scatter zone x, the shell area 30 is provided with an unperforated, closed outer surface. The suction slot 15 of the roller 1 (FIG. 3A) rotating into the wedge-shaped gap 3 extends along the area of the processing zone y in parallel to the wedge-shaped gap 3 and at a small distance from it. In the area of the scatter zone x, the suction slot 15, opposite the rotating direction of the roller 1, is displaced away from the wedge-shaped gap 3 in a section 29 with a continuous inclination and then changes over into a section 28 that is separated by a distance a in the circumferential direction opposite the rotating direction with respect to the wedge-shaped gap 3. This section 28 that essentially is assigned to the yarn tip 9 again extends in parallel to the wedge-shaped gap 3. The shell of the roller 1, over the whole area of the suction slott 15, is provided with perforations 27. By means of this measure, the friction effect in the area of the yarn tip 9 is reduced. Still, particularly the air current required for the perfect fiber transport is not reduced.

In the case of the embodiment according to FIGS. 3A and 3B, the shell area 30 is smooth and not perforated. In order to increase a friction effect that is caused only by the surface of the roller 2 rotating out of the wedge-shaped gap 3, it is provided in an another embodiment that this surface of the shell area 30 is developed in such a way that an increased friction effect is ahieved. An increased friction effect may, for example, also be obtained when a perforation is provided in this shell area 30, although it is ot required for the desired air currents.

Figure 4:
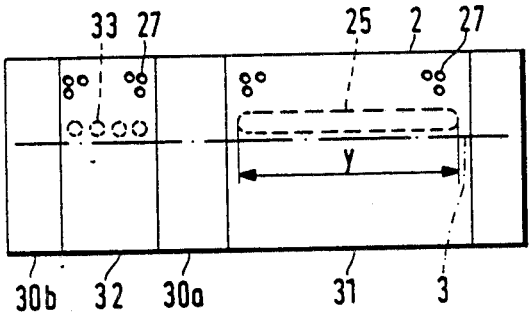
FIG. 4 shows an arrangement of a suction slot of a suction insert of a roller rotating out of the wedge-shaped gap in accordance with the present invention.

In the case of some fiber materials, it may happen that some fibers are caught at the shell of the roller 1 rotating into the wedge-shaped gap 3 and rotate with it instead of being bound into the yarn 8. In order to avoid this, in the embodiment according to FIG. 4, it is provided that the shell of the roller 2 rotating out of the wedge-shaped gap 3 in the area of the scatter zone x is comprised of two shell areas **30*b* and 30*a* between which a perforated shell area 32 is provided. In this area, the suction insert 21, i.e., the tube 22 and the sleeve 23 are provided with one or several air inlet openings 33, the overall cross-section of which is significantly smaller than the cross-section of the actual suction slot 25, the cross-sections differing by an order of magnitude (i.e. by a factor of 10). By means of these air inlet openings 33, an air current is generated that has the effect that the otherwise rotating fibers are detached from the roller 1 and are bound into the yarn 8**.

Figure 5:
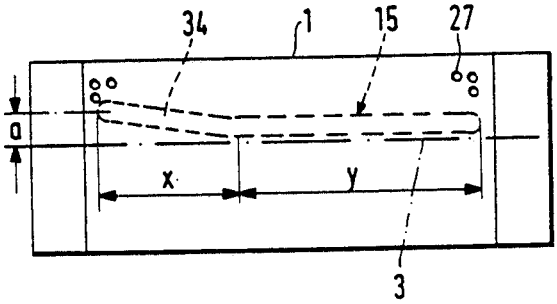
FIGS. 5 to 9 show arrangements and developments of suction slots of suction inserts of rollers rotating into the wedge-shaped gap in accordance with the present invention.

In the case of the embodiment according to FIG. 5 of a roller 1 rotating into the wedge-shaped gap 3, it is provided that the suction slot 15 in the processing zone y extends in parallel to the wedge-shaped gap 3. In the direction of the yarn tip 9, in the scatter zone x, opposite the yarn withdrawal direction E, the slot is displaced away from the wedge-shaped gap 3 and at its end assigned to the actual yarn tip 9, reaches a distance a. In the scatter zone x, a section 34 of the suction slot 15 therefore exists that from the distance a, continously approaches the wedge-shaped gap 3 in yarn withdrawal direction E. In the area of the yarn tip 9, the suction air current thus extends less deeply into the wedge-shaped gap 3 than in the area of the end of the scatter zone x.

Figure 6:
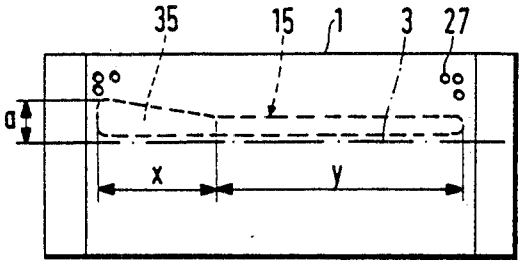

In the case of the embodiment according to FIG. 6, it is provided that the suction slot 15 in the area of the processing zone y extends in parallel and at a small distance from the wedge-shaped gap 3. In the area of the scatter zone x, on the other hand, an expanding section 35 is provided that has a limiting wall extending in parallel to the wedge-shaped gap 3 and a limiting wall displaced away from the wedge-shaped gap 3 obliquely in a direction opposite the yarn withdrawal direction E. By means of this type of section 35 of the suction slot 15, it is possible to increase the air current in the area of the scatter zone x in order to improve the transport of the fibers in the fiber feeding duct 5 without this air current significantly increasing the friction effect in the area of the yarn tip 9.

Figure 7:
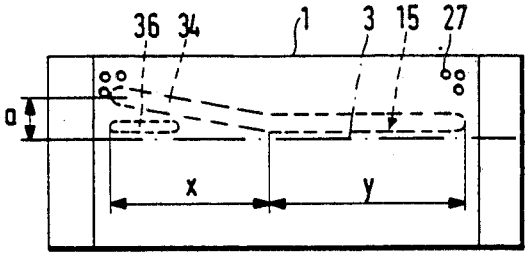

In the case of the embodiment according to FIG. 7, it is provided that a suction slot 5 corresponding to the embodiment according to FIG. 5 is assigned to the suction roller 1 rotating into the wedge-shaped gap 3. A suction slot 15 extends in the processing zone y in parallel and close to the wedge-shaped gap 3 and in the scatter zone x has a section 34 that opposite the yarn withdrawal direction E continously moves away from the wedge-shaped gap 3. In addition, in the area of the yarn tip 9, i.e., the end of the scatter zone x that faces away from the yarn withdrawal device E, an additional suction slot section 36 is provided that faces the wedge-shaped gap 3 and extends in parallel to it. This suction slot section 36 that is developed to be significantly narrower than the section 34 and, for example, has only a third of its width, essentially determines the friction effect in the area of the yarn tip 9.

Figure 8:
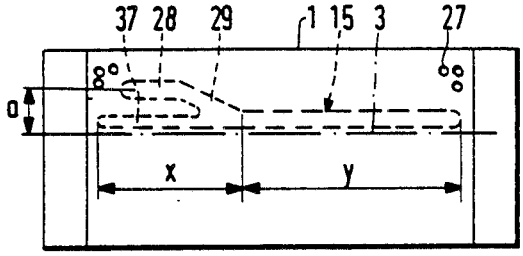

In the case of the embodiment according to FIG. 8, a suction slot 15 is first assigned to the roller 1 rotating into the wedge-shaped gap 3 that in its shape corresponds to the embodiment according to FIG. 3A. This suction slot 15, in the processing zone y, has a section 37 aimed at the wedge-shaped gap 3 and extending in parallel to it. Section 29 is connected opposite the yarn withdrawal direction E in the scatter zone x and is continuously aimed away from the wedge-shaped gap 3. This section 29 is followed by a section 28 extending in parallel to the wedge-shaped gap 3 and having a separation a therefrom. In addition, in the case of the embodiment according to FIG. 8, it is provided that in the area of the scatter zone x, another section 37 of the suction slot 15 is provided that extends in parallel to the wedge-shaped gap 3 and is aimed at it. This section 37 that in the area of section 29 leads into the suction slot 15, again has a significantly smaller opening cross-section that amounts approximately to only one third of the opening cross-section of sections 29 and 28.

Figure 9:
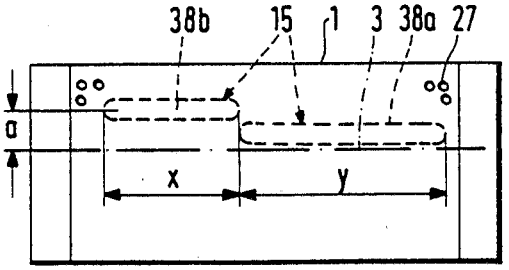

In the case of the embodiment according to FIG. 9, it is provided that the suction slot 15 assigned to the roller 1 rotating into the wedge-shaped gap 3 is divided into two sections **38*a* and 38*b* that are separated from one another. Section 38*a* assigned to the processing zone y is aimed at the wedge-shaped gap 3 and extends in parallel to it. Section 38*b* that is assigned to the scatter zone x, with respect to the section 38*a*, is staggered against the rotating direction of the roller and, at a distance a, extends parallel to the wedge-shaped gap 3**.

In the case of all embodiments, it is advantageously provided that at least the suction device 11 of the roller 1 rotating into the wedge-shaped gap 3 has an adjusting device by means of which at least the area of the suction slot 15 that is assigned to the scatter zone x can be adjusted with respect to its opening cross-section. As a result, it is possible to proportion the sucked-in air volume and/or friction effect, particularly in the area of the yarn tip 9. This type of adjusting device is, by means of FIGS. 10 to 12, explained for a suction slot arrangement corresponding to FIG. 9. Corresponding adjusting devices are contemplated also for all other embodiments.

Figure 10:
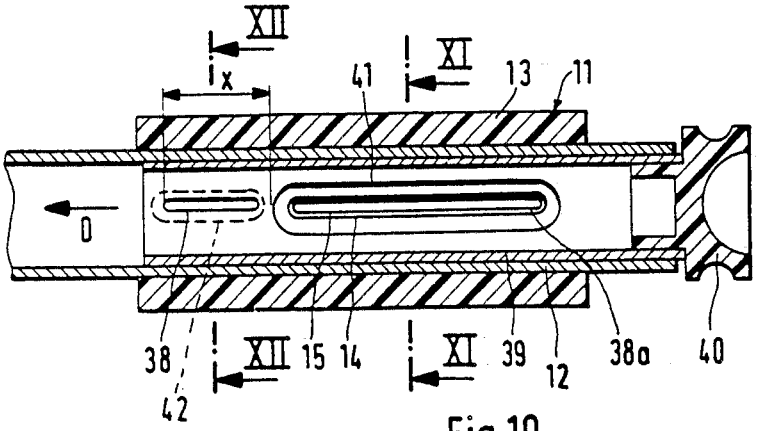
FIG. 10 shows an axial section through a suction insert with an arrangement of a suction slot corresponding to FIG. 9 having an adjusting device for the adjusting of the free cross-section of this suction insert in accordance with the present invention.
Figure 11:
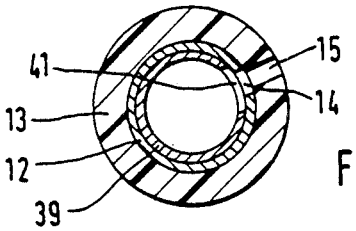
FIG. 11 shows a section along Line XI—XI through the suction insert of FIG. 10.
Figure 12:
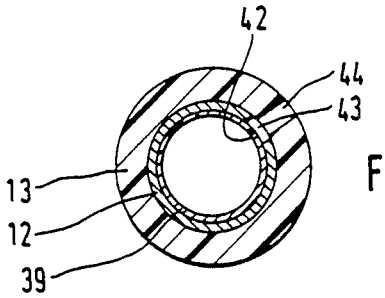
FIG. 12 shows a section along Line XII—XII of the suction insert according to FIG. 10.

In the case of the embodiment according to FIGS. 10 to 12, a sleeve 39 is fitted inside the tube 12 of the suction insert 11. The sleeve 39 extends over the whole length of the suction slot 15 and is closed at its end by means of a plug 40 that, at the same time, is developed as a turning handle. The sleeve 39 can be turned inside the tube 12. It is provided with a longitudinal slot 41 extending in parallel to section 38*a* of the suction slot 15. The longitudinal slot 41 is significantly wider than the slot 14 of the tube 12 as shown in FIG. 11. In addition, the sleeve 39 is provided with a longitudinal slot 42 extending in parallel to the section 38*b* of the suction slot 15. This longitudinal slot 42 is narrower than the longitudinal slot 41. By the twisting of the sleeve 39, the opening cross-section can therefore be adjusted to the desired extent in the area of the section 38*b*.

When the adjusting device according to FIGS. 10 to 12 is employed with suction slots 15 corresponding to the embodiments according to FIGS. 1 to 8, it is required that, instead of the longitudinal slot 42, a longitudinal slot is provided that is adapted to the respective course of the sections of the suction slot 15 assigned to the scatter zone x.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. An apparatus for open-end friction spinning including first and second adjacently arranged friction rollers drivable in the same rotational direction and defining a wedge-shaped gap therebetween for forming a yarn, said rollers each having a perforated outer shell and suction inserts arranged therein, each said suction insert being provided with a suction slot facing the wedge-shaped gap and extending in the direction of the wedge-shaped gap, said first friction roller rotating into the wedge-shaped gap and said second friction roller rotating out of the wedge-shaped gap, said suction slot of the suction insert of the first roller having a greater length than the suction slot of the suction insert of the second roller.

2. An apparatus according to claim 1, further comprising feeding device means for feeding individual fibers to the wedge-shaped gap, and yarn withdrawal means for withdrawing forming yarn from the wedge-shaped gap.

3. An apparatus according to claim 1, wherein the suction slot of the suction insert of the first roller is about twice the length of the suction slot of the suction insert of the second roller.

4. An apparatus according to claim 1, wherein said wedge-shaped gap comprises a scattering zone wherein a yarn tip is formed and a processing zone wherein forming yarn is further twisted and smoothened.

5. An apparatus according to claim 4, wherein said suction slot of said second roller extends only along said processing zone.

6. An apparatus according to claim 1, wherein said outer shell of said second roller contains perforations along an axial length of the roller corresponding to the length of the suction slot of the second roller.

7. An apparatus according to claim 6, wherein said outer shell of said second roller is perforated only over said axial length corresponding to the length of said suction slot of said second roller.

8. An apparatus according to claim 4, wherein said suction insert of said second roller has at least one air inlet opening adjacent said scatter zone, said inlet opening being aimed at the wedge-shaped gap, said outer shell of said second roller being perforated in an area adjacent said air inlet opening.

9. An apparatus according to claim 8, wherein said at least one air inlet opening exhibits an inlet size smaller than the width of said suction slot of said suction insert.

10. An apparatus according to claim 9, wherein said inlet opening is about one-tenth of the width of said suction slot.

11. An apparatus according to claim 4, wherein said suction slot of said first roller extends over the length of said scatter zone and said processing zone.

12. An apparatus according to claim 4, wherein said suction slot of said first roller in said scatter zone includes a portion having a greater separation from said wedge-shaped gap then a second portion of said suction slot located in said processing zone.

13. An apparatus according to claim 12, wherein said portion of said suction slot of said first roller adjacent said scatter zone extends substantially parallel to said wedge-shaped gap.

14. An apparatus according to claim 12, wherein said separation decreases in a yarn withdrawal direction.

15. An apparatus according to claim 8, wherein said suction slot of said first roller includes an additional section extending from a portion of said suction slot located in said processing zone.

16. An apparatus according to claim 15, wherein said additional section has a smaller inlet width than said suction slot separated from said wedge-shaped gap.

17. An apparatus according to claim 4, wherein said suction insert of said first roller is provided with adjustment means for adjusting the opening of said suction slot.

18. An apparatus according to claim 17, wherein said adjusting means is operable adjacent said scatter zone.

19. An apparatus according to claim 2, wherein said feeding device includes a fiber feeding duct having a mouth extending along said wedge-shaped gap, said fiber feeding device being angularly arranged relative to said wedge-shaped gap.

20. An apparatus according to claim 17, wherein said suction insert comprises tube means and said adjusting means comprises cylindrical adjusting sleeve means inside said tube means.

* * * * *